United States Patent [19]

Nieuwendijk et al.

[11] Patent Number: 4,723,296

[45] Date of Patent: Feb. 2, 1988

[54] ELECTRODYNAMIC TRANSDUCER OF THE ISOPHASE OR RIBBON TYPE

[75] Inventors: Joris A. M. Nieuwendijk; Georgius B. J. Sanders; Johannes W. T. Bax, all of Eindhoven, Netherlands

[73] Assignee: U.S. Philips Corporation, New York, N.Y.

[21] Appl. No.: 852,610

[22] Filed: Apr. 16, 1986

[30] Foreign Application Priority Data

Apr. 23, 1985 [NL] Netherlands ..... 8501166

[51] Int. Cl.[4] ..... H04R 9/04; H04R 7/04; H04R 7/18

[52] U.S. Cl. ..... 381/192; 381/193; 381/196; 381/199; 381/201

[58] Field of Search ..... 179/115 V, 115.5 R, 179/115.5 PV, 115 R, 115.5 DV, 115.5 ES, 115.5 VC, 117, 119 R, 138, 181 R; 381/192–196, 199–203

[56] References Cited

U.S. PATENT DOCUMENTS

| | | | |
|---|---|---|---|
| 3,898,598 | 8/1975 | Asahi | 381/158 |
| 3,919,498 | 11/1975 | Beer | 381/196 |
| 3,922,503 | 11/1975 | Tabuchi | 381/196 |
| 4,018,627 | 3/1978 | Crist | 381/196 |
| 4,264,789 | 4/1981 | Kaizu et al. | 381/196 |
| 4,273,968 | 6/1981 | Suyama | 381/158 |
| 4,276,452 | 6/1981 | Suyama et al. | 381/158 |
| 4,338,489 | 7/1982 | Görike | 381/191 |
| 4,484,037 | 11/1984 | Nieuwendijk et al. | 381/159 |
| 4,491,698 | 1/1985 | Larson et al. | 381/196 |
| 4,544,806 | 10/1985 | Nieuwendijk et al. | 381/156 |
| 4,653,103 | 3/1987 | Mori et al. | 381/196 |

FOREIGN PATENT DOCUMENTS

| | | | |
|---|---|---|---|
| 52-43419 | 4/1977 | Japan | 179/115.5 PV |
| 55-99898 | 7/1980 | Japan | 179/115.5 PV |
| 55-105495 | 8/1980 | Japan | 179/115.5 PV |
| 60-106799 | 8/1985 | Japan | 381/193 |

OTHER PUBLICATIONS

PCT WO83/02708, Torgeson, W., Lee, "Full Range Planar Induction Loudspeaker"; Aug. 1983.

*Primary Examiner*—Thomas W. Brown
*Assistant Examiner*—Danita R. Byrd
*Attorney, Agent, or Firm*—Robert T. Mayer; Bernard Franzblau

[57] ABSTRACT

An electro-dynamic transducer of the isophase or ribbon type includes a vibratile diaphragm (7) arranged in the air gap of the transducer magnet system and having a current conductor (9) arranged thereon. An additional layer (23, 24) of material is arranged on at least one part of the diaphragm, e.g. in a space (11) between the pole plates. In order to extend the operating frequency range of the transducer, the additional layer is divided into sections (25, 26) with the area of each section being at least an order of mangitude smaller than the area of the one part of the diaphragm. These sections are distributed more or less uniformly over the one part of the diaphragm. It is possible to reduce distortion and increase the sensitivity of the transducer.

12 Claims, 2 Drawing Figures

ELECTRODYNAMIC TRANSDUCER OF THE ISOPHASE OR RIBBON TYPE

BACKGROUND OF THE INVENTION

This invention relates to an electrodynamic transducer comprising a magnet system having a first pole and a second pole between which at least one air gap is formed, and a diaphragm which is arranged in the air gap and on which at least one conductor is arranged.

Such a transducer is known from U.S. Pat. No. 4,273,968. The transducer described in said patent (see for example FIG. 4) has the disadvantages that the distortion components in the output signal are comparatively large, in particular at low frequencies, that the lower limit of the operating-frequency range of the transducer is situated at relatively high frequencies, and that the sensitivity of the transducer is not very high.

SUMMARY OF THE INVENTION

It is an object of the invention to provide a transducer which can have a larger operating-frequency range, i.e. a transducer whose operating frequency range extends down to lower frequencies, and which, by taking additional steps, can reduce the distortion and increase the sensitivity at the expense of a part of the resulting extension of the operating frequency range.

The electrodynamic transducer in accordance with the invention is characterized in that in addition to the conductor(s) an additional layer is arranged on at least a part of the diaphragm, which layer is divided into sections whose areas are each at least an order of magnitude smaller than the area of said part of the diaphragm, and said sections are more or less uniformly distributed over said part of the diaphragm.

The step in accordance with the invention is based on the recognition of the following fact. The lowest resonant frequency of the diaphragm, and hence the lower limit of the operating frequency range, is fixed for a specific volume $v_o$ enclosed between the diaphragm and the magnet system, a given mass of the diaphragm and the conductors and a given tensile stress in the diaphragm.

This lower limit may be shifted towards lower frequencies by reducing the tensile stress in the diaphragm. However, this leads to an increased distortion, which is undesirable.

Further, as a result of the leakage flux a substantial part of the magnetic field between the two poles does not assist in driving the diaphragm, which results in the low sensitivity of the known transducer. Alternatively, the enclosed volume $v_o$ may be reduced. The result of this is a higher sensitivity owing to the reduced leakage flux and the increased magnetic field in the air gap. Another consequence is that the lower limit of the operating frequency range is shifted towards higher frequencies, which is also undesirable. If now the tensile stress in the diaphragm is reduced again, the original operating frequency range may be obtained again, but this will be at the expense of an increased distortion, so that ultimately the result is not beneficial.

The use of an additional layer leads to an increase in the mass of the diaphragm. If, moreover, the additional layer is divided into sections, this can ensure that the flexural stiffness of this layer does not affect the lowest resonance frequency of the diaphragm, so that the compliance of the diaphragm is not reduced significantly.

The lowest frequency $f_o$ can be determined from the formula $$f_o = \frac{1}{2\pi}\sqrt{1/mC},$$

where m is the mass of the diaphragm plus the conductors and the additional layer, and C is the compliance, which is dictated by the compliance of the diaphragm and the compliance of the air volume $v_o$. It follows that by providing the additional layer, m increases and $f_o$ is consequently shifted towards lower frequencies. This results in a transducer with a larger operating frequency range which, depending on the additional mass, is achieved by sacrificing a part of the sensitivity at low frequencies. However, the reduced sensitivity may be compensated for by a reduction of the mechanical damping of the diaphragm.

A satisfactory result is obtained in particular if the sections are distributed more or less uniformly over the first-mentioned part of the diaphragm, which sections each have an area which is at least an order of magnitude smaller than the area of said part of the diaphragm. Preferably, the areas of the sections are made even smaller, for example at least two orders of magnitude smaller. In the case of a diaphragm of rectangular shape, the sections are, for example, rectangular and have a length and width smaller than or equal to 1/10 of the length and width respectively of the moving part of the diaphragm. It is obvious that the area depends on the material used for the additional layer and on the thickness of this additional layer. The sections should be smaller as the thickness of the additional layer increases. The sections should also be smaller as the modulus of elasticity of the additional layer increases.

Obviously, the sections may be for example oval or circular instead of rectangular.

By applying additional steps to such a transducer, the distortion can be reduced and the sensitivity can be increased in exchange for part of the extension of the operating frequency range. This can be achieved as follows.

A reduction of the enclosed volume $v_o$ yields an increased sensitivity. This is on account of the previously mentioned fact that the leakage flux decreases because the reluctance of the magnetic circuit decreases. By reducing the enclosed volume $v_o$ only to a limited extent, it is possible to obtain both an extension of the operating frequency range and a sensitivity which is higher than the original sensitivity.

Moreover, as a result of the reduction of the enclosed volume $v_o$ the compliance of this volume, exerted on the diaphragm, is reduced, which means that the distortion decreases. This can be explained as follows. As a result of the reduction of the enclosed volume $v_o$ the lower limit of the operating frequency range is shifted towards higher frequencies, while the reduction of the enclosed volume $v_o$ has substantially no or at least a smaller influence on the resonance frequencies corresponding to the higher vibration modes of the diaphragm. These higher vibration modes are one of the causes of the large distortion. As a result of the shift of the lower limit a number of resonances of higher vibration modes, which are originally situated within the operating range, are now situated outside, i.e. below, the operating range of the transducer, so that the distortion is reduced significantly.

Furthermore, by reducing the enclosed volume $v_o$, the magnet system can be of a more compact construction.

Preferably, the material of the additional layer is the same as the conductor material. This has the advantage that the conductor(s) and the section can be formed by etching a metal layer deposited on the diaphragm, which is a cheap method of forming the additional layer. Moreover, the amount of material of the metal layer to be etched away is reduced considerably so that the etchant is weakened less rapidly.

This also results in a diaphragm with a more uniform behaviour over the entire diaphragm surface than in the case of a diaphragm provided only with the conductor(s) and not with the additional layer.

It is to be noted that U.S. Pat. No. 4,264,789 discloses a transducer which comprises a diaphragm which, in addition to the conductor(s), is covered entirely with a metal layer in order to facilitate the removal of heat produced by the signal currents in the conductor(s).

Further, U.S. Pat. No. 3,922,503 discloses reinforcement elements in the form of metal coatings on the diaphragm between the conductors. The object of these elements is to increase the flexural stiffness of the diaphragm, which is in conflict with the object of the present invention. Moreover, the coatings are not distributed uniformly, so that for this reason too the desired effect cannot be achieved.

In an electrodynamic transducer of the ribbon type as described in U.S. Pat. No. 4,484,037, the transducer comprises a first pole in the form of a pole plate which comprises two plate-shaped members which define a space in which an edge portion of the movable part of the diaphragm is situated, and a second pole in the form of a centre pole, the part of the diaphragm which is situated in said space is preferably provided with the additional layer divided into sections. This enables the desired effects to be obtained in a transducer for the reproduction of a mid-frequency range which extends between (very) low frequencies and (very) high frequencies.

BRIEF DESCRIPTION OF THE DRAWING

The invention will now be described in more detail, by way of example, with reference to the accompanying drawing. In the drawing.

DESCRIPTION OF THE PREFERRED EMBODIMENTS

Figure 1:
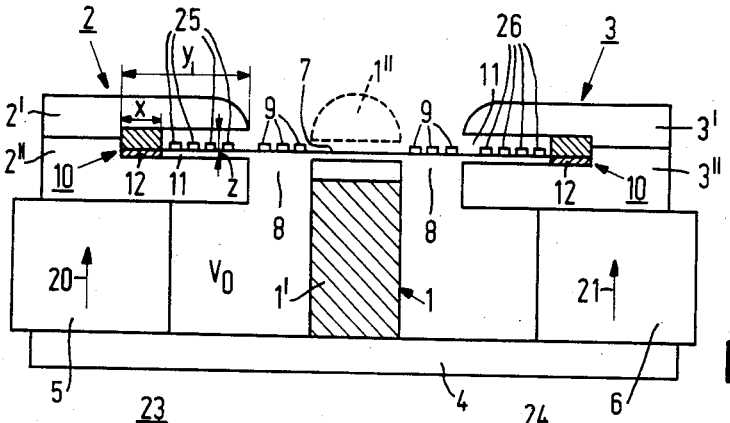
FIG. 1 shows an electrodynamic transducer embodying the invention.

FIG. 1 is a sectional view of an electrodynamic transducer in accordance with the invention. The construction of the magnet system used in the embodiment shown in FIG. 1 corresponds to the construction of the magnet system of the transducer disclosed in U.S. Pat. No. 4,484,037. The transducer may be of a circular or rectangular shape. In the latter case FIG. 1 is a sectional view of the transducer taken in a direction perpendicular to the longitudinal directions of the conductors in an air gap. The magnet system of the transducer comprises a first pole in the form of a pole plate 2, 3, which comprises two plate-shaped members 2', 2" and 3', 3", a second pole in the form of a center pole 1, a closing plate 4, and the members 5 and 6. The magnetic field in the magnet system can be obtained by constructing the members 5 and 6 as permanent magnets. The direction of magnetization is indicated by the arrows 20 and 21. However, the directions of magnetization may also be reversed. The other parts of the magnet system are of a soft-magnetic material, for example soft iron.

In a circular transducer the reference numerals 5, 6 represent the cross-section of an annular magnet. In the rectangular version the reference numerals 5 and 6 denote the cross-sections of two bar magnets which extend parallel to each other. It is alternatively possible to use a soft magnetic material for the members 5 and 6 and to construct the centre pole, at least its shaded portion 1', as a permanent magnet.

In the circular version an air gap 8 is formed between the pole plates 2, 3 and the center pole 1. The air gap 8 and the pole plates 2, 3 are then annular. In the rectangular version air gaps 8 are formed between the pole plate 2 and the center pole 1 and between the pole plate 3 and the center pole 1, which gaps extend parallel to each other like the pole plates 2 and 3. In the air gap (air gaps) 8 a diaphragm 7 is arranged, which carries at least one conductor 9 which extends over the diaphragm surface in a direction perpendicular to the plane of the drawing. FIG. 1 shows either three conductors which extend parallel to each other over the diaphragm surface in an air gap, or one conductor which extends over the diaphragm surface in the form of a "spiral" having three turns around the centre pole. The conductors are connected to an audio amplifier (not shown) in such a way that the signal currents in the conductor(s) 9 between the pole plate 2 and the center pole 1 flow perpendicular to the plane of the drawing and the signal currents in the conductor(s) 9 between the pole plate 3 and the centre pole 1 flow in the opposite direction. As the magnetic field in the air gap 8 between the upper plate 2 and the center pole 1 extends within or parallel to the plane of the diaphragm (see later) and is directed oppositely to the magnetic field in the air gap 8 between the pole plate 3 and the centre pole 1, the diaphragm performs an excursion of substantially the same phase over its entire area. Therefore, this is referred to as an isophase transducer or, more specifically, a ribbon loudspeaker.

The pole plate (pole plates) 2, 3 each comprises two plate members 2', 3' and 2", 3". Parts of the facing major surfaces of the two plate members 2', 3' and 2", 3" butt against each other, which major surfaces extend substantially in and parallel to the plane of the diaphragm. Another part of said major surface of one or both plate members (of both members in FIG. 1) recedes slightly, as indicated by the numeral 10, so that a space 11 is formed. The diaphragm 7 is now arranged between the plate members 2', 3' and 2", 3" in such a way that an edge portion of the diaphragm is situated in said space (s) 11. The diaphragm 7 may, for example, be tensioned on or in a frame 12, which is secured between the two plate members. However, alternatively the diaphragm may be clamped between the members 2', 2" and 3', 3". The width x of the frame 12 is smaller than the width y of the space 11. Moreover, the height z of the space 11 is such that the movable part of the edge portion of the diaphragm 7, which is situated in the space 11, can move freely and cannot contact the pole plate (pole plates) 2, 3.

Instead of forming at least one of the major surfaces with a re-entrant portion, the space 11 may be formed between the two plateshaped members by interposing, for example, a plate of a soft-magnetic material between the two facing major surfaces. The thickness of the soft-magnetic plate should then correspond to the height z of the space 11.

Furthermore, in the spaces 11 a damping material (not shown) may be arranged underneath and/or on the diaphragm, which material is in mechanical contact with the diaphragm. This damping material damps the higher natural resonances of the diaphragm (these are free vibrations of the diaphragm in a vibration pattern corresponding to a natural frequency of the diaphragm, caused by driving the diaphragm), which leads to an improved output signal of the transducer, i.e. an output signal which is less distorted.

Preferably, the center pole 1 also extends on the other side of the diaphragm. The portion 1'' on this side of the diaphragm is indicated by a broken line. The part of the diaphragm which is situated between the two parts 1 and 1'' of the centre pole is freely movable. The part 1'' is kept in the position shown by means of a support, not shown. For a better impedance matching to the medium in which the transducer radiates its acoustic signals, the end surfaces of the members 1'', 2' and 3' which face the air gap 8 are rounded. This means that in a direction perpendicular to the diaphragm surface these end surfaces diverge from each other as the distance from the diaphragm surface increases, so that a horn-like radiation aperture is formed.

In addition to the conductor(s) 9, a part of the diaphragm 7, in the present embodiment that part of the diaphragm 7 situated in the space(s) 11, carries an additional layer, which is divided into sections 25, 26 whose areas are each at least one order of magnitude smaller than the area of the part of the diaphragm situated in the space(s) 11. Preferably, the areas of the sections are at least two orders of magnitude smaller.

Figure 2:
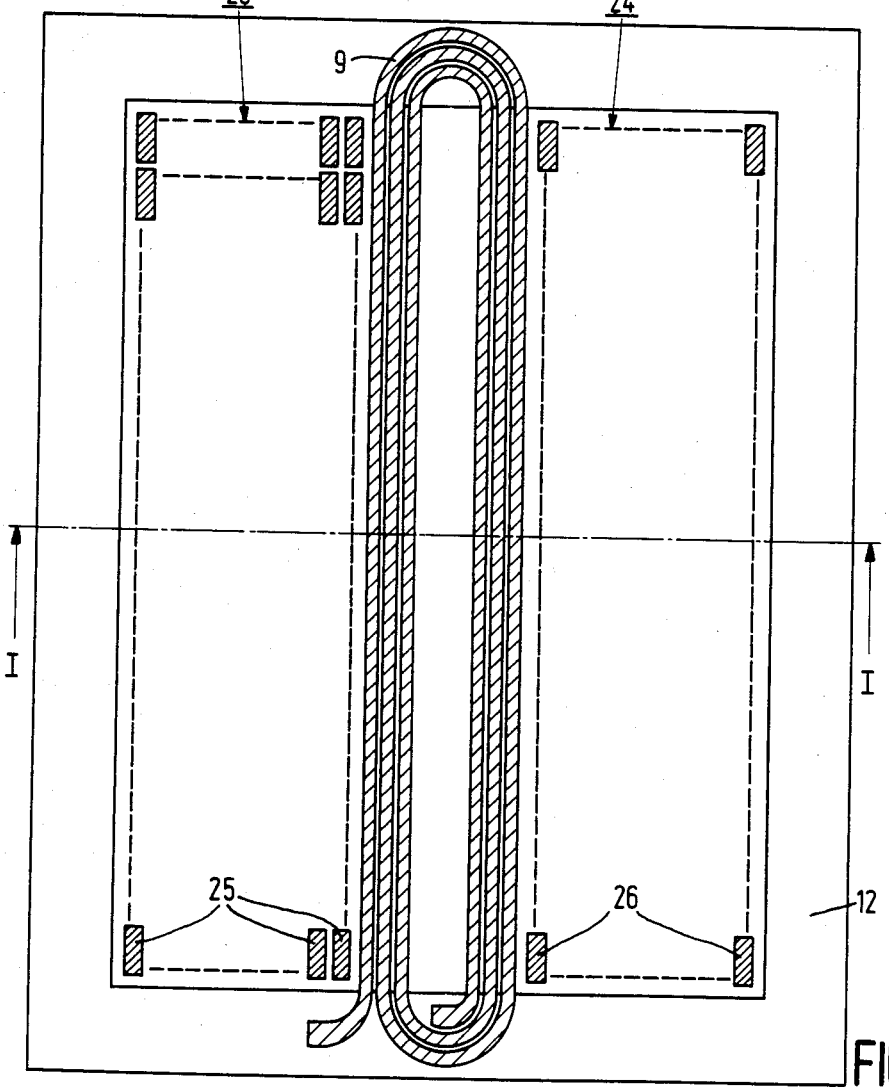
FIG. 2 shows an example of a diaphragm provided with the additional layer.

FIG. 2 is a plan view of the diaphragm 7 of FIG. 1 tensioned in the frame 12, FIG. 1 being a sectional view taken on the line I—I in FIG. 2. The diaphragm is a diaphragm for a rectangular transducer. On the diaphragm additional layers 23 and 24 are arranged on the left and the right of the conductor 9, which layers are each divided into sections 25 and 26. The sections are uniformly distributed. Preferably, the sections 25, 26 have a length and width equal to or smaller than 1/10 of the length and width respectively of the moving part of the diaphragm.

The shape of the sections 25, 26 need not necessarily be rectangular. For example, circular or square sections are alternatively possible. Further, the uniform distribution of the sections over the diaphragm parts to the left and the right of the conductor need not be as strict as is shown in FIG. 2.

For the material of the additional layers 23 and 24 different possibilities are available. For example, a layer of an elastomeric or other material arranged in sections is possible. Another possibility is to make the additional layers 23 and 24 of the same material as the material of the conductor 9. The conductors and the additional layers 23 and 24 may then be formed by etching a metal layer deposited on the entire surface.

For the choice of the material and the thickness of the additional layer and the dimensions of the sections the following should be borne in mind.

As a result of the tensile stress in the diaphragm and its dimensions the tensioned diaphragm without the additional layer has a (lowest) natural resonance frequency $f_o$. The modulus of elasticity of the diaphragm material is of no significance. In an equivalent diagram, the system may be described as a mass-spring system in which $f_o$ complies with $$f_o = \frac{1}{2\pi}\sqrt{\frac{1}{cm}}$$

where m is the mass of the diaphragm (and the conductor) and C is the compliance of the diaphragm. The requirement imposed on the additional layer may now be translated as follows: the additional layer should only result in an increase in mass but the compliance of the diaphragm should not (or hardly) be affected by the use of the additional layer. This menas that the flexural stiffness (which is a function of inter alia the modulus of elasticity) of the material of the additional layer should not influence the compliance of the diaphragm. This is achieved by dividing the additional layer in the more or less uniform manner. It follows from the foregoing that, inter alia, the dimensions of the sections should be reduced for an additional layer of a material with a high (higher) modulus of elasticity. The same applies to a thicker additional layer.

As already stated, the additional step of reducing the volume $v_o$ enclosed between the diaphragm and the magnet system, see FIG. 1, is aimed at inter alia an increased sensitivity. This reduction of $v_o$ can be realized in the construction shown in FIG. 1 by shifting the elements (magnets) 5 and 6 further towards the centre pole 1. The lower reluctance of the magnetic circuit and the reduced leakage flux cause the magnet field in the air gap 8 to become stronger, which results in a higher sensitivity.

It is to be noted that the invention is not limited to the present embodiment. Various modifications of the embodiment described are possible without departing from the scope of the invention as defined in the claims. The step in accordance with the invention may be applied to, for example, transducers of the isophase type, as described in, for example, U.S. Pat. No. 4,264,789, and in transducers of the ribbon type as described in, for example, U.S. Pat. No. 4,273,968.

What is claimed is:

1. An electrodynamic transducer comprising a magnet system having a first pole and a second pole between which at least one air gap is formed, and a diaphragm located in the air gap with conductor means arranged on said diaphragm, an additional layer arranged on an area of at least a part of the diaphragm, said layer being divided into sections having areas that are each at least an order of magnitude smaller than the area of said part of the diaphragm and with the sections substantially uniformly distributed over said part of the diaphragm.

2. An electrodynamic transducer as claimed in claim 1, wherein the area of each of the sections is at least two orders of magnitude smaller than the area of said part of the diaphragm.

3. An electrodynamic transducer as claimed in claim 2, wherein the additional layer comprises a material that is the same as the conductor material.

4. An electrodynamic transducer as claimed in claim 3, wherein the conductor means and the sections are formed by etching a metal layer so that said sections are electrically separated from one another such that there is no current flow between said sections.

5. An electrodynamic transducer as claimed in claim 2, wherein the diaphragm has a moving part which has a rectangular shape having a length and width dimension, and the sections are also rectangular and each have a length and width dimension smaller than or equal to 1/10 of the length and the width dimension, respectively, of the moving part of the diaphragm.

6. An electrodynamic transducer as claimed in claim 1, said transducer being of the ribbon type wherein the first pole is in the form of a pole plate, said pole plate comprising two plate-shaped members which define a space in which an edge portion of a movable part of the diaphragm is situated, and said second pole is in the form of a centre pole, characterized in that the part of the diaphragm situated in said space includes the additional layer divided into sections.

7. An electrodynamic transducer as claimed in claim 1, wherein the additional layer comprises a material that is the same as the conductor material.

8. An electro-acoustic transducer comprising:

a magnet system which includes at least one magnet, pole plate means and a center pole, said pole plate means and said center pole being spaced apart so as to form at least one air gap therebetween, said pole plate means having a space therein adjacent the air gap, a vibratile diaphragm disposed in the air gap and having a peripheral portion located within said space in the pole plate means, at least one conductor arranged on said diaphragm, an additional layer of material arranged on an area of at least a part of said diaphragm with said additional layer divided into segments each having an area at least an order of magnitude smaller than the area of said part of the diaphragm and with the segments approximately uniformly distributed over said part of the diaphragm.

9. A transducer as claimed in claim 8 wherein the material of the additional layer is the same as the conductive material.

10. A transducer as claimed in claim 8 wherein the area of each said segment is at most 1/10 of the area of said part of the diaphragm.

11. A transducer as claimed in claim 8 wherein said conductor comprises a spiral flat conductor arranged on the diaphragm in an area thereof separate from said part on which said additional layer is arranged.

12. A transducer as claimed in claim 8 wherein said part of said diaphragm on which the additional layer is arranged is located within said space in the pole plate means.

* * * * *